United States Patent [19]

Patuzzi et al.

[11] 4,188,021

[45] Feb. 12, 1980

[54] METALLURGICAL VESSEL COOLING AND SAFETY SYSTEM

[75] Inventors: Alexander Patuzzi; Manfred Eysn, both of Linz, Austria

[73] Assignee: Voest-Alpine Aktiengesellschaft, Linz, Austria

[21] Appl. No.: 896,458

[22] Filed: Apr. 14, 1978

[51] Int. Cl.[2] ..... C21C 5/28

[52] U.S. Cl. ..... 266/88; 165/70; 266/89; 266/193

[58] Field of Search ..... 266/78, 87, 89, 241, 266/190, 193, 194, 88; 165/70, 71

[56] References Cited

U.S. PATENT DOCUMENTS

| | | | |
|---|---|---|---|
| 3,395,676 | 8/1968 | Sprague | 165/70 |
| 3,966,180 | 6/1976 | Patuzzi et al. | 266/241 |

*Primary Examiner*—John McQuade

*Attorney, Agent, or Firm*—Brumbaugh, Graves, Donohue & Raymond

[57] ABSTRACT

A metallurgical vessel cooling system with cooling chambers provided on the wall of the vessel is arranged so that the cooling chambers can be quickly emptied of the cooling water by connecting the chambers to a pressure gas line. This system is particularly useful for one or more converters with a converter hood having cooling chambers extending in the generatrix direction and connected to horizontally extending coolant passages. These passages are in turn connected to a coolant supply system by means of coolant supply and drain lines. The supply or drain line contains supervisor or signalling devices for checking the pressure and/or temperature and/or amount of coolant. These signalling devices, in the case of a deviation from a predetermined value, actuate controls for separating the supply and drain means from the coolant supply system and connecting one of these conduit means to the pressure gas line.

11 Claims, 2 Drawing Figures

METALLURGICAL VESSEL COOLING AND SAFETY SYSTEM

BACKGROUND OF THE INVENTION

The invention relates to a metallurgical vessel cooling system, in particular a cooling system for a steel making converter having cooling chambers through which a cooling liquid flows and provided on the wall of the vessel.

Liquid cooled metallurgical vessels have only a relatively small amount of liquid in the interior of the cooling chambers provided on the wall of these vessels. Thus, if the supply of the cooling chambers with cooling liquid is disturbed, there is the danger of overheating and vapor formation in the interior of the cooling chambers. Such overheating and vapor formation would come about within a very short period of time owing to the small amount of liquid in the interior of the cooling chambers and owing to the high temperature prevailing in the interior of the metallurgical vessel, so that there is the risk of explosions of the cooling chambers and damage to the metallurgical vessel. Connected therewith is not only the danger of destruction of the overall plant, but also a high risk of injury to the operating personnel.

SUMMARY OF THE INVENTION

The present invention aims at avoiding these disadvantages and difficulties and has as its object to provide a metallurgical vessel cooling system and means by which the cooling liquid can be removed from the cooling chambers within a very short period of time without the risk of vapor formation and explosions.

In accordance with the invention this object is achieved in that, for the purpose of draining the cooling liquid, the cooling chambers are connectable to a pressure gas line.

In accordance with a preferred embodiment this cooling system is employed for a converter hood having, arranged at its periphery, a plurality of cooling chambers extending in the generatrix direction of the hood area, through which area coolant flows. The chambers are connected to distributor and collector conduit sections extending horizontally around the periphery of the converter hood, these sections being connected to a coolant supply system by means of supply conduits extending through one or both of the carrying trunnions of the converter. The cooling system is characterized in that the supply conduit(s) or drain conduit(s) contain supervisor or signalling means for checking the pressure and/or the temperature and/or the amount of coolant flowing through them. Also control means are provided which are actuated by these supervisor or signalling means in the event of a deviation from a maximum or minimum desired value on the part of the parameters of the cooling liquid supervised so as to separate the conduits from the coolant supply system and to connect one of them to the pressure gas line.

Suitably, a plurality of converters is connected to a common coolant supply system and a common source of compressed air.

BRIEF DESCRIPTION OF THE DRAWINGS

The invention shall now be illustrated in more detail on the basis of an embodiment shown schematically in the drawings, in which.

DESCRIPTION OF AN EXEMPLARY EMBODIMENT

Figure 1:
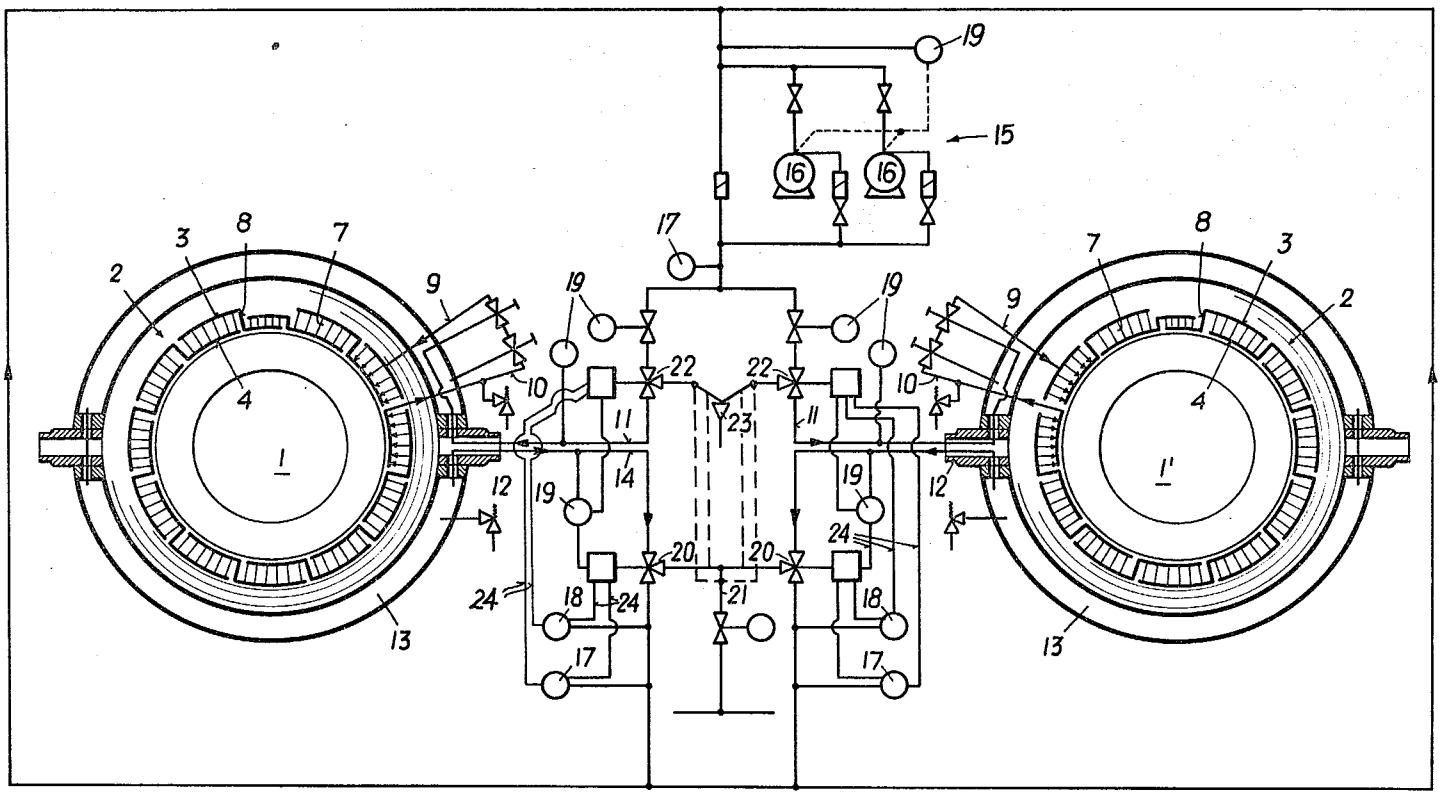
FIG. 1 shows two steel making converters as seen from above, partly in section.
Figure 2:
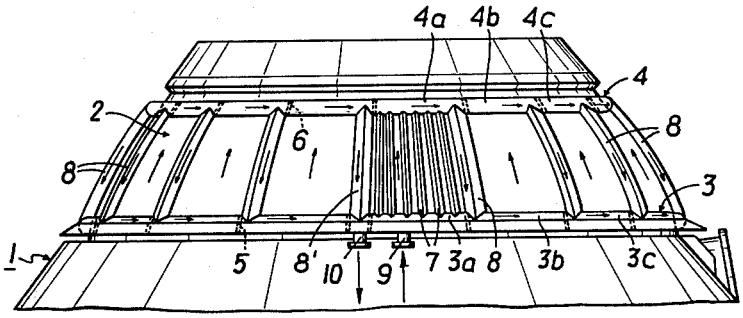
FIG. 2 is a side view of the converter hood of one of the two converters.

On the jacket face of a converter hood 2 of converters 1, 1', annular conduits are provided at a distance from one another and extend horizontally, i.e. the lower distributor conduit 3 and the upper collector conduit 4. These annular conduits are sectionally partitioned by parting walls 5 and 6, respectively, so that distributor conduit sections 3*a*, 3*b*, 3*c* . . . and collector conduit sections 4*a*, 4*b*, 4*c* . . . follow upon one another. Between the two annular conduits 3 and 4, a plurality of channel-like cooling chambers 7 is arranged in groups, in the generatrix direction of the hood area, i.e. in vertical planes through the center of the vessel. These chambers 7 comprise groove-shaped sections or corner irons that are welded to the jacket face of the converter hood. To each such group of cooling chambers, one single reflux tube 8 is allocated, which reflux tube has a groove-shaped section welded to the jacket face of the hood and an accordingly wider cross section than the cooling chambers. The reflux tubes are arranged in such a manner that one upper collector conduit section, e.g. 4*a*, is always connected with the following lower distributor section, e.g. 3*b*, via a reflux tube 8. One lower distributor conduit section 3*a* is connected to the coolant inlet 9 and the last drain tube 8' is connected to the coolant outlet 10.

The coolant inlet 9 is connected to a supply conduit 11 that has been guided through the carrying trunnion 12 of the converters 1, 1'. The coolant outlet 10, on the other hand, in the case of both converters 1, 1', runs into the respective carrying ring 13, which is of hollow design, whereby the cooling liquid is forced to flow through the carrying ring after it flows through the converter hood. After flowing through the carrying ring 13, the cooling liquid is led to the coolant supply system via the drain conduit 14. The coolant supply system in its entirety is denoted with 15 and is formed from the pumps 16, the required pipe lines and the regulating valves not being illustrated in detail. The coolant supply system 15, in accordance with the embodiment shown, is designed as a closed system. The cooling liquid, preferably renewed cooling water, is returned to the supply conduit 11 by means of the pumps 16. For supervising various state parameters of the cooling liquid, a plurality of signalling means 17, 18, 19 is installed in the supply and drain 11, 14 of each converter 1, 1'. The signalling means 17 serves for supervising the temperature, the signalling means 18 for supervising the amount of coolant flowing through the system and finally the signalling means 19 serves for supervising the pressure of the cooling liquid.

In the drain conduits 14 of each converter 1, 1', moreover, one control means each is provided. The control means is designed as valve 20 and with the help of this valve each drain conduit 14 can be separated from the coolant supply system 15 and connected to a pressure gas line 21, preferably a compressed air line.

In each supply conduit 11 a control means, also designed as a valve 22, is provided so as to make it possible to separate the supply conduit 11 from the coolant supply system 15 and to connect the supply conduit to an overflow line 23. The two valves 20, 22 can be actuated by the signalling means 17, 18, 19 via the control lines 24.

The coolant supply system 15 as well as the pressure gas line 21, serves for the simultaneous feeding of both converters 1, 1'.

The functioning of the cooling system described is as follows:

While the metallurgical vessel operates, the cooling water supplied by the pumps 16 at first flows through the converter hood cooling arrangement of each converter 1, 1'. Subsequently it runs through the carrying ring and is then returned to the pumps 16 via the drain conduit 14. As soon as one of the signalling means 17, 18, 19 for supervising the pressure, the temperature and the amount of cooling water, respectively, records a value deviating from the range in which the cooling of the converter is reliably safeguarded, the valves 20, 22 of the respective converter are automatically actuated via the control lines 24, which is done by having valve 22 connect the supply conduit 11 with the overflow 23 and the valve 20 connect the drain conduit 14 with the pressure gas line 21. Thereby the cooling chambers 7 of the converter hood 2 are passed through by compressed air and the amount of cooling liquid still present in them is forced out into the overflow 23 within the shortest time, i.e. before any vapor formation can come about. The flow direction of the compressed air in this case is opposite to the flow direction of the cooling liquid, which offers advantages because the reflux tubes 8 have a greater cross section than the chambers 7.

The invention is not restricted to the embodiment shown in the drawings, but can be modified in various ways. It is for instance, possible to provide, instead of the cooling elements for the converter hood formed by annular conduits and cooling chambers, cooling chambers formed by plate cooling elements in addition the cooling elements may be formed by tube windings led in meander-like manner around the converter hood. Moreover, the cooling chambers of the converter hood need not be arranged to follow one after the other as in the embodiment shown, but they can be combined in various groups, each parallely connected to the coolant supply system with a separate supply and drain conduit. It is also possible to have the compressed air flow through the cooling chambers in the direction of flow of the cooling liquid by interchanging the pressure gas line 21 and overflow line 23 as shown in dotted line in FIG. 1.

What we claimed is:

1. A metallurgical vessel cooling system, in particular a cooling system for a steel-making converter, including a coolant supply means, cooling elements provided on the wall of the vessel and coolant conduit means for connecting said supply means to said elements, said conduit means and elements being flown through by a coolant from said supply means, the improvement comprising:

a pressure gas line to which the coolant conduit means are adapted to be alternatively connected for emptying the coolant from the conduit means and the cooling elements, coolant monitoring means contained in the coolant conduit means for checking at least one parameter of the coolant, and control means actuated by the coolant monitoring means for separating the coolant conduit means from the coolant supply means and connecting the coolant conduit means to the pressure gas line whenever the at least one parameter checked deviates from a pre-determined value.

2. A cooling system as set forth in claim 1 wherein the system is adapted to be used for at least one converter supported by two carrying trunnions, the walls of the converter in the upper region thereof forming a converter hood wherein said cooling elements comprise a plurality of cooling chambers extending over the periphery of the converter hood substantially in the generatrix direction thereof and flown through by the coolant, coolant distributor conduit sections and coolant collector conduit sections extending horizontally over the periphery of the converter hood and connected to the cooling chambers; and wherein said coolant conduit means runs through at least one of the carrying trunnions and connects the coolant distributor conduit sections and coolant collector conduit sections, respectively, to the coolant supply system.

3. A cooling system as set forth in claim 2, wherein the coolant conduit means comprises at least one coolant supply conduit and at least one coolant drain conduit, the coolant monitoring means being contained in the at least one coolant drain conduit.

4. A cooling system as set forth in claim 2, wherein the coolant conduit means comprises at least one coolant supply conduit and at least one coolant drain conduit, the coolant monitoring means being contained in the at least one coolant supply conduit.

5. A cooling system as set forth in claim 2, wherein the coolant conduit means comprises a coolant supply conduit and a coolant drain conduit and wherein the control means are adapted to be actuated to separate the coolant supply conduit and the coolant drain conduit from the coolant supply means and to connect the coolant drain conduit to the pressure gas line.

6. A cooling system as set forth in claim 2, wherein the coolant conduit means comprises a coolant supply conduit and a coolant drain conduit and wherein the control means are adapted to be actuated to separate the coolant supply conduit and the coolant drain conduit from the coolant supply means and to connect the coolant supply conduit to the pressure gas line.

7. A cooling system as set forth in claim 2, wherein the at least one parameter of the coolant to be checked by the coolant monitoring means is the pressure of the coolant.

8. A cooling system as set forth in claim 2, wherein the at least one parameter of the coolant to be checked by the coolant monitoring means is the temperature of the coolant.

9. A cooling system as set forth in claim 2, wherein the at least one parameter of the coolant to be checked by the coolant monitoring means is the amount of coolant flowing through said coolant conduit means.

10. A cooling system as set forth in claim 2 for a plurality of converters, wherein a common coolant supply means and a common pressure gas line are provided to which the converters are connectable.

11. A cooling system as set forth in claim 10, wherein the pressure gas line is a source of compressed air.

* * * * *